US007963807B1

(12) United States Patent
Yang

(10) Patent No.: US 7,963,807 B1
(45) Date of Patent: Jun. 21, 2011

(54) AUDIO JACK CONNECTOR

(75) Inventor: Chih-lin Yang, Tu Cheng (TW)

(73) Assignee: Cheng Uei Precision Industry Co., Ltd., Tu Cheng, Taipei (TW)

( * ) Notice: Subject to any disclaimer, the term of this patent is extended or adjusted under 35 U.S.C. 154(b) by 0 days.

(21) Appl. No.: 12/916,581

(22) Filed: Oct. 31, 2010

(51) Int. Cl.
*H01R 13/625* (2006.01)

(52) U.S. Cl. ..... 439/668

(58) Field of Classification Search ..... 439/668, 439/669, 188; 200/51.09
See application file for complete search history.

(56) References Cited

U.S. PATENT DOCUMENTS 7,238,059 B1 * 7/2007 Wu ..... 439/668
7,361,062 B2 * 4/2008 Long et al. ..... 439/668
7,387,543 B1 * 6/2008 Wu et al. ..... 439/668
* cited by examiner

*Primary Examiner* — T C Patel
*Assistant Examiner* — Harshad C Patel
(74) *Attorney, Agent, or Firm* — Cheng-Ju Chiang

(57) ABSTRACT

Provided is an audio jack connector, including an insulating housing and a plurality of contacts. The insulating housing disposes a plurality of contact-receiving grooves including a third contact-receiving groove and a switching contact-receiving groove. The third contact-receiving groove comprises a locking groove and a third accepting groove. The contacts includes a third signal contact having a latch portion, a spring arm being bent inward from a lower end of the latch portion and then tiltedly extending forward, and a third contacting portion tiltedly extending upward from a tail end of the spring arm. The latch portion is retained in the locking groove, and the spring arm and the contacting portion is received in the third accepting groove. The audio jack connector of the present invention can obtain better mechanical properties by the deflection design of the spring arm of the third signal contact.

4 Claims, 4 Drawing Sheets

AUDIO JACK CONNECTOR

BACKGROUND OF THE INVENTION

1. Field of the Invention

The present invention relates to a connector, and more particularly to an audio jack connector.

2. Description of the Prior Art

FIGS. 1 and 2 disclose a prior audio jack connector 100', including an insulating housing 10' and a plurality of contacts received in the insulating housing 10'. The insulating housing 10' disposes a plurality of contact-receiving grooves including a first contact-receiving groove 121', a second contact-receiving groove 131' and a third contact-receiving groove 111'. The contacts, including a first signal contact 30', a second signal contact 40' and a third signal contact 20', are separately contained in the first, second and third contact-receiving grooves 121', 131' and 111'. The third contact-receiving groove 111' includes a third holding groove 111' extending up and down, and a third accepting groove 112' located on a bottom wall 101' of the insulating housing 10' and communicated with the third holding groove 111'. The third signal contact 20' has a planar third holding portion 21', a locking portion 22' located on one side of the third holding portion 21', a spring arm 23' extending downward from a lower end of the locking portion 22' and then bent inward, and a third contacting portion 24' tiltedly extending from an end of the spring arm 23'. The third contacting portion 24' disposes a raised portion 25'. The third holding portion 21' and the locking portion 22' are retained in the third holding groove 111' of the insulating housing 10'. The spring arm 23' and the third contacting portion 24' are received in the third accepting groove 112'.

However, the spring arm 23' of the prior third signal contact 20' has a short arm of force, and the plastic deformation is easily produced during movement of the spring arm 23'. The action space of the spring arm 23' is small so that the spring arm 23' is easily protruding from the bottom surface of the insulating housing 10'.

BRIEF SUMMARY OF THE INVENTION

An object of the present invention is to provide an audio jack connector, which has better mechanical properties including avoiding the permanent deformation of a signal contact, providing a larger action space for the signal contact and preventing the signal contact from exceeding out of a bottom surface of an insulating housing.

To achieve the above object, in accordance with the present invention, an audio jack connector is provided for being mounted on a circuit board. The audio jack connector of the present invention comprises an insulating housing and a plurality of contacts. The insulating housing disposes a plurality of contact-receiving grooves including at least one third contact-receiving groove and a switching contact-receiving groove. The third contact-receiving groove comprises a third holding groove, a locking groove, a third extending groove and a third accepting groove. The contacts are separately mounted in the contact-receiving grooves of the insulating housing, and includes at least one third signal contact having a third holding portion, a latch portion, a third soldering portion being bent outward from a front portion of an upper end of the third holding portion and then extending to be bent downward, a spring arm being bent inward from a lower end of the latch portion and then tiltedly extending forward, and a third contacting portion tiltedly extending upward from a tail end of the spring arm. The third holding portion of the third signal contact is fixed in the third holding groove, the latch portion is retained in the locking groove, the third soldering portion extends out of the third extending groove, and the spring arm and the contacting portion is received in the third accepting groove.

Based on the above description, the audio jack connector of the present invention can increase the length of the arm of force for obtaining better mechanical properties, such as avoiding the permanent deformation of the third signal contact, providing a larger action space for the third signal contact and preventing the third signal contact from exceeding out of a bottom surface of an insulating housing, by the deflection design of the spring arm of the third signal contact.

DETAILED DESCRIPTION OF THE PREFERRED EMBODIMENTS

The following embodiment with reference to the accompanying drawings now has been given for detail describing the technology, the feature, the object and the effect of the present invention.

Figure 1:
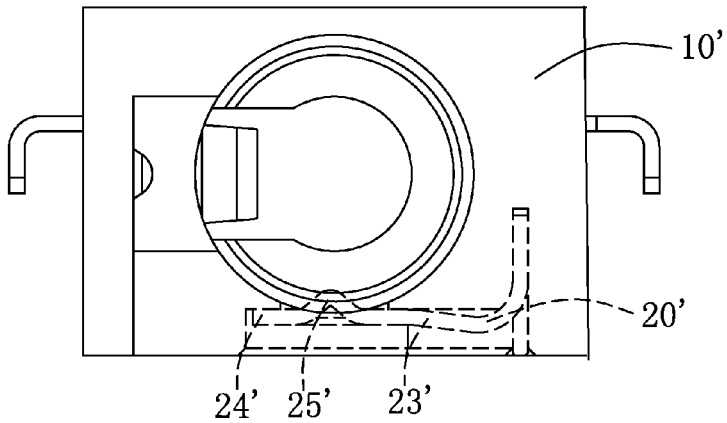
FIG. 1 (Prior Art)
FIG. 1 is a front plane view of a prior audio jack connector, wherein a third signal contact is shown in dashed lines.
Figure 2:
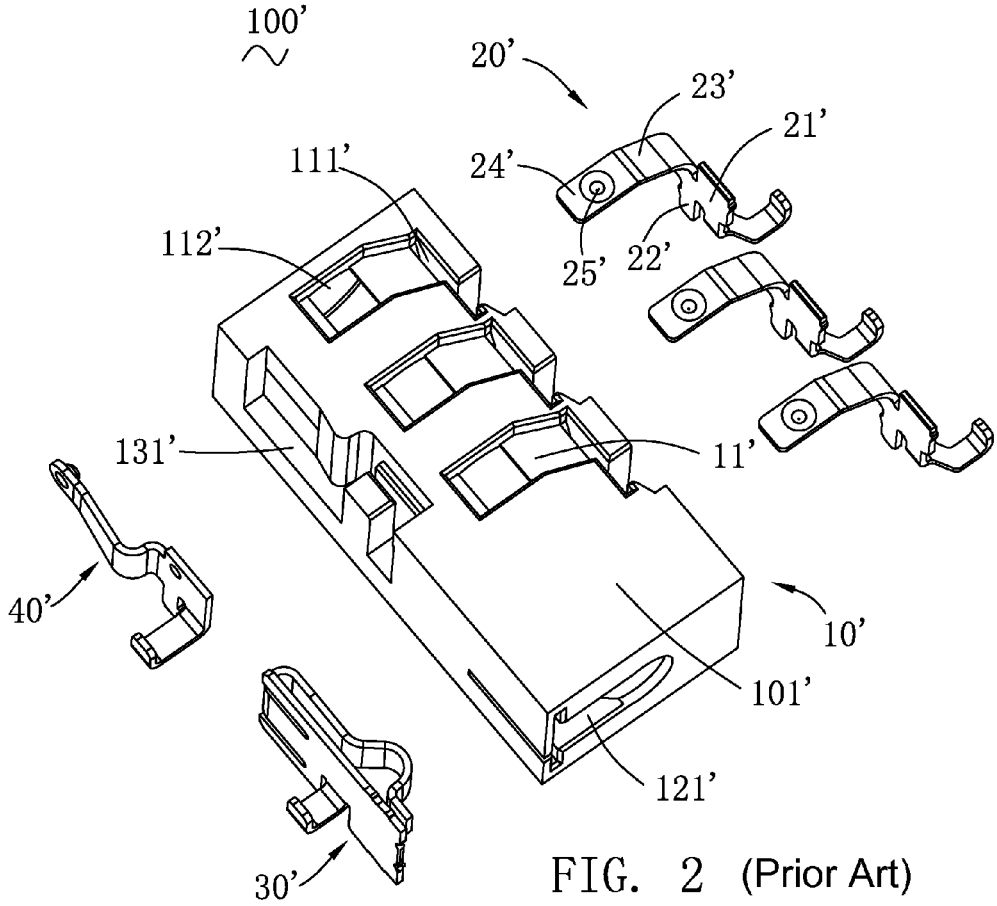
FIG. 2 (Prior Art)
FIG. 2 is an exploded perspective view of the prior audio jack connector.
Figure 3:
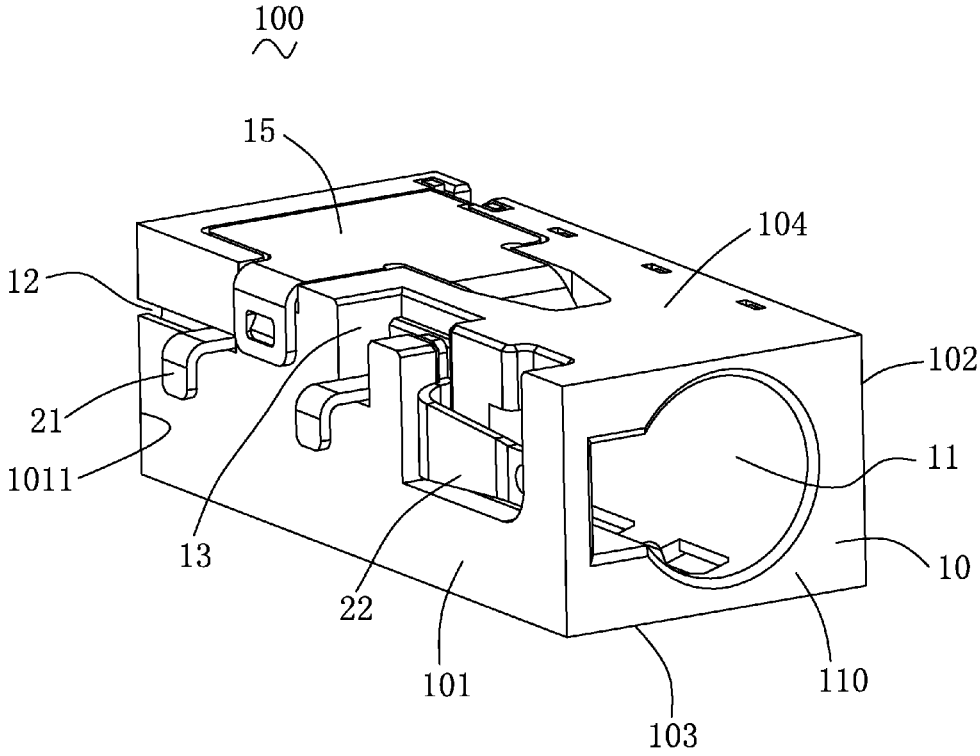
FIG. 3 is a perspective view of an audio jack connector according to one embodiment of the present invention.

Referring to FIG. 3, an audio jack connector 100 of the present invention comprises an insulating housing 10 and a plurality of contacts received in the insulating housing 10.

Figure 4:
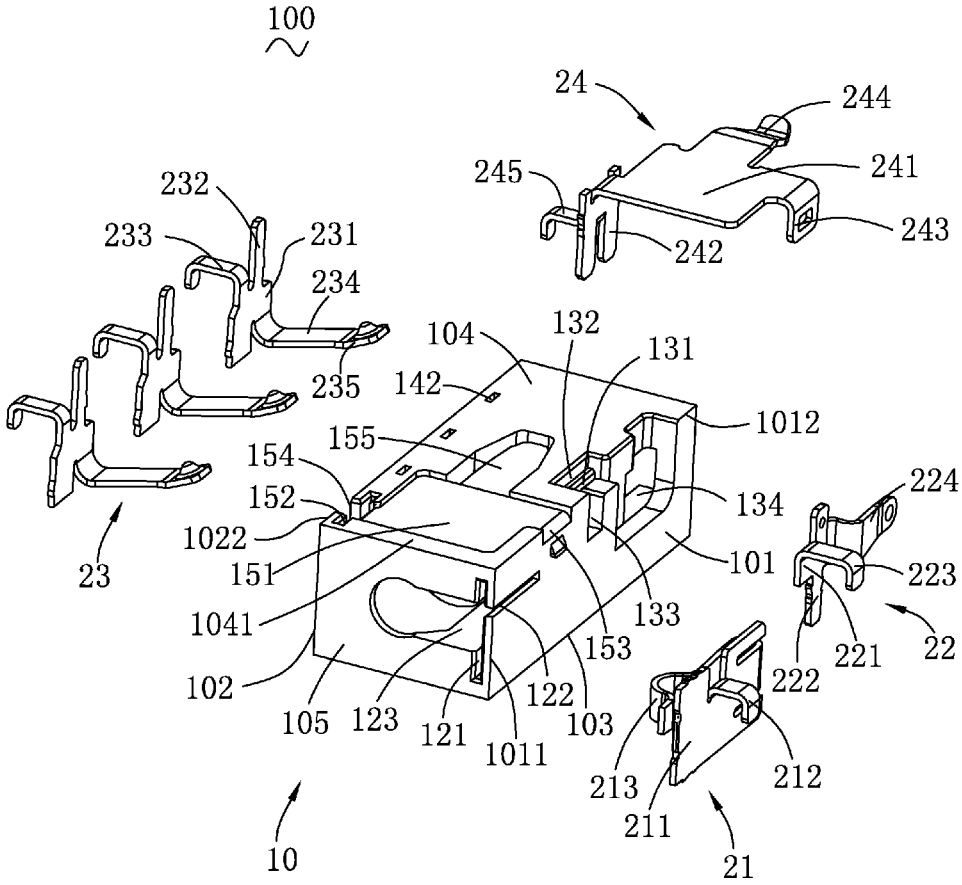
FIG. 4 is an exploded perspective view of the audio jack connector of FIG. 3.
Figure 5:
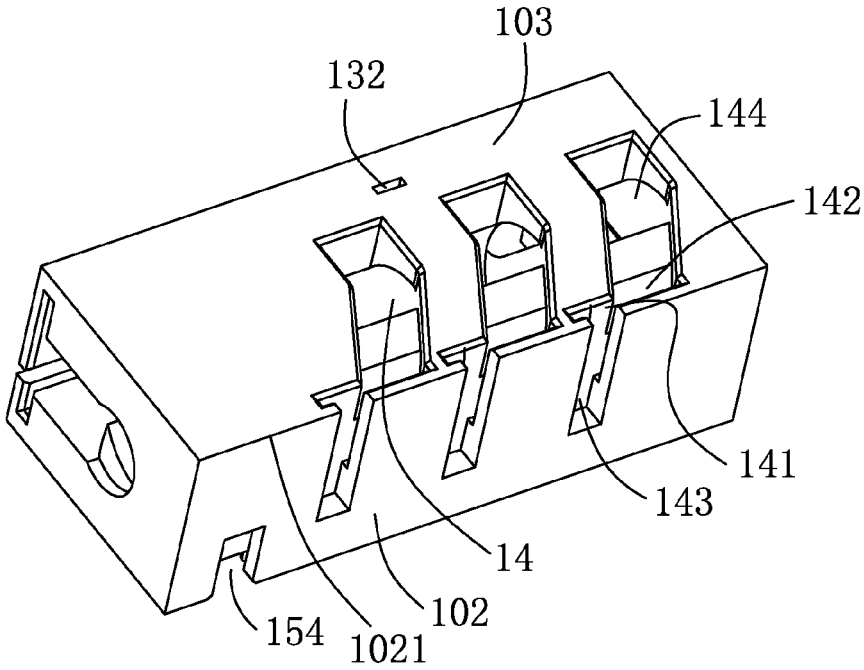
FIG. 5 is an another perspective view of the audio jack connector of FIG. 3.
Figure 6:
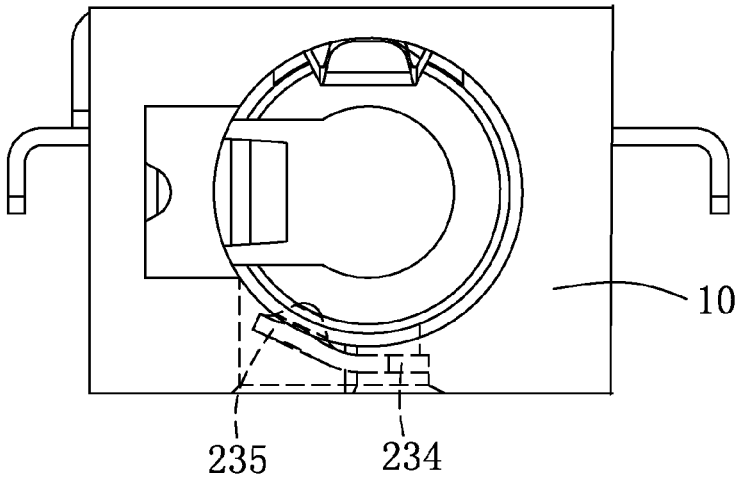
FIG. 6 is a front plane view of the audio jack connector of FIG. 3, wherein a third signal contact is shown in dashed lines.

Referring to FIGS. 3, 4 and 5, the insulating housing 10 is general rectangular. The insulating housing 10 disposes an inserting hole 11 located on a front wall 110 thereof and extending backward, a first contact-receiving groove 12 extending forward from a back end 1011 of a left wall 101 thereof and communicated with the inserting hole 11, a second contact-receiving groove 13 located on the left wall 101 and on the front of the first contact-receiving groove 12, a plurality of third contact-receiving grooves 14 located on a right wall 102 thereof and extending to a bottom wall 103 thereof, and a switching contact-receiving groove 15 located on a top wall 104 thereof.

As shown in FIG. 4, the first contact-receiving groove 12 comprises a first holding groove 121 extending backward from the back end 1011 of the left wall 101, a first extending groove 122 communicated with the first holding groove 121 and extending to an outer surface of the left wall 101, and a first accepting groove 123, which is communicated with the first holding groove 121 and extending along a back wall 105 to be communicated with the inserting hole 11. As shown in FIG. 4, the second contact-receiving groove 13 comprises a second holding groove 131 extending downward from an upper portion 1012 of the left wall 101, a retaining groove 132 communicated with the second holding groove 131 and extending downward unto the bottom wall 103, a second extending groove 133 communicated with the second holding groove 131 and extending to the outer surface of the left wall 101, and a second accepting groove 134 communicated with the second holding groove 131 and the inserting hole 11. As shown in FIG. 5, each one of the third contact-receiving grooves 14 comprises a third holding groove 141 extending upward from a bottom end 1021 of the right wall 102, a locking groove 142 communicated with the third holding groove 141 and extending upward unto the top wall 104 of the insulating housing 10, a third extending groove 143 communicated with the third holding groove 141 and extending to an outer surface of the right wall 102, and a third accepting groove 144 communicated with the third holding groove 141 and extending along the bottom wall 103. As shown in FIG. 4, the switch contact-receiving groove 15 comprises a shallow groove 151 located on a back portion 1041 of the bottom wall 104, a fourth holding groove 152 formed on a back portion 1022 of the right wall 102, a securing groove 153 communicated with the shallow groove 151 and extending to the outer surface of the left wall 101, a fourth extending groove 154 communicated with the fourth holding groove 152 and extending to the outer surface of the right wall 102, and a fourth accepting groove 155 extending forward from a middle portion of the shallow groove 151 and passing through the top wall 104 of the insulating housing 10.

Please continuously refer to FIGS. 4 and 5, the contacts comprises a first signal contact 21, a second signal contact 22, a plurality of third signal contacts 23 and a switching contact 24. The first signal contact 21 has a first holding portion 211 being vertical plate-shaped, a first soldering portion 212 being bent outward from a middle portion of an upper end of the first holding portion 211 and then extending to be bent downward, and a first contacting portion 213 being bent inward and backward from a middle portion of a front end of the first holding portion 211 and extending backward. The second signal contact 22 has a second holding portion 221 being vertical plate-shaped, a retaining portion 222 extending downward from a lower end of the second holding portion 221, a second soldering portion 223 being bent outward from the second holding portion 221 and then extending to be bent downward, and a second contacting portion 224 being bent outward from a front end of second holding portion 221 and then extending to be bent inward. The third signal contacts 23 has a third holding portion 231 being vertical plate-shaped, a latch portion 232 extending upward from a back portion of an upper end of the third holding portion 231, a third soldering portion 233 being bent outward from a front portion of the upper end of the third holding portion 231 and then extending to be bent downward, a spring arm 234 being bent inward from a lower end of the latch portion 232 and tiltedly extending forward, and a third contacting portion 235 tiltedly extending upward from a tail end of the spring arm 234. The switching contact 24 has an extending portion 241 being vertical plate-shaped, a fourth holding portion 242 being bent and extending downward from one side of the extending portion 241, a securing portion 243 being bent and extending downward from the other side of the extending portion 241, a fourth contacting portion 244 extending forward from a middle portion of a front end of the extending portion 241, and a fourth soldering portion 245 being bent outward and then extending to be bent downward.

Referring to FIGS. 3 to 6, when assembling, the first holding portion 211 of the first signal contact 21 is fixed in the first holding groove 121 of the insulating housing 10, the first soldering portion 212 passes through and extends out of the first extending groove 122, and the first contacting portion 213 is received in the first accepting groove 123. The second holding portion 221 of the second signal contact 22 is fixed in the second holding groove 131 of the insulating housing 10, the retaining portion 222 is retained in the retaining groove 132, the second soldering portion 223 passes through and extends out of the second extending groove 133, and the second contacting portion 224 is received in the second accepting groove 134 and extends inward into the inserting hole 11. The third holding portion 231 of the third signal contact 23 is fixed in the third holding groove 141 of the insulating housing 10, the latch portion 232 is retained in the locking groove 142, the third soldering portion 233 extends out of the third extending groove 143, and the spring arm 234 and the third contacting portion 235 is received in the third accepting groove 144. The fourth holding portion 242 is fixed in the fourth holding groove 152, the extending portion 241 is received in the shallow groove 151, the securing portion 243 is secured in the securing groove 153, the fourth contacting portion 244 is received in the fourth accepting groove 155, and the fourth soldering portion 245 extends out of the fourth extending groove 154.

As described above, the audio jack connector 100 of the present invention can increase the length of the arm of force for obtaining better mechanical properties, such as avoiding the permanent deformation of the third signal contact 23, providing a larger action space for the third signal contact 23 and preventing the third signal contact 23 from exceeding out of a bottom surface of an insulating housing 10, by the deflection design of the spring arm 234 of the third signal contact 23.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An audio jack connector comprising:

an insulating housing, disposing a plurality of contact-receiving grooves including at least one third contact-receiving groove and a switching contact-receiving groove, wherein the third contact-receiving groove comprises a third holding groove, a locking groove, a third extending groove and a third accepting groove; and a plurality of contacts, being separately mounted in the contact-receiving grooves of the insulating housing, and including at least one third signal contact having a third holding portion, a latch portion, a third soldering portion being bent outward from a front portion of an upper end of the third holding portion and then extending to be bent downward, a spring arm being bent inward from a lower end of the latch portion and then tiltedly extending forward, and a third contacting portion tiltedly extending upward from a tail end of the spring arm;

wherein the third holding portion of the third signal contact is fixed in the third holding groove, the latch portion is retained in the locking groove, the third soldering portion extends out of the third extending groove, and the spring arm and the contacting portion is received in the third accepting groove.

2. The audio jack connector as claimed in claim 1, wherein the contacts further includes a switching contact having an extending portion, a fourth holding portion, a securing portion, a fourth contacting portion and a fourth soldering portion; the switching contact-receiving groove includes a shallow groove, a fourth holding groove, a securing groove, a fourth extending groove and a fourth accepting groove; the fourth holding portion of the switching contact is retained in the fourth holding groove; the extending portion is received in the shallow groove; the securing portion is held in the securing groove; the fourth contacting portion is received in the fourth accepting groove; and the fourth soldering portion extends out of the fourth extending groove.

3. The audio jack connector as claimed in claim 1, wherein the insulating housing disposes an inserting hole being located on a front wall thereof and extending backward.

4. The audio jack connector as claimed in claim 3, wherein the contact-receiving grooves of the insulating housing further includes a first contact-receiving groove extending forward from a back end of a left wall of the insulating housing and being communicated with the inserting hole, and a second contact-receiving groove located on the left wall of the insulating housing and on the front of the first contact-receiving groove; and the contacts further includes a first signal contact received in the first contact-receiving groove, and a second signal contact received in the second contact-receiving groove.

* * * * *